United States Patent [19]

Kasuya

[11] 4,238,311

[45] Dec. 9, 1980

[54] CATHODE FOR USE IN ELECTROLYSIS AND METHOD FOR THE PRODUCTION THEREOF

[75] Inventor: Kazuki Kasuya, Ichihara, Japan

[73] Assignee: Chlorine Engineers Corporation, Ltd., Tokyo, Japan

[21] Appl. No.: 8,813

[22] Filed: Feb. 2, 1979

[30] Foreign Application Priority Data

Feb. 20, 1978 [JP] Japan ..... 53-17690

[51] Int. Cl.[3] ..... C25B 11/06; C25B 11/02; B01J 25/02

[52] U.S. Cl. ..... 204/290 R; 204/291; 204/292; 252/477 Q

[58] Field of Search ..... 204/290 R, 291, 292

[56] References Cited

U.S. PATENT DOCUMENTS

| | | | |
|---|---|---|---|
| 1,302,959 | 6/1919 | Page | 204/290 R |
| 2,305,539 | 12/1942 | Lowry | 204/290 R |
| 2,727,842 | 12/1955 | Vermij | 204/290 R X |
| 3,216,919 | 11/1965 | White et al. | 204/258 |
| 4,024,044 | 5/1977 | Brannan et al. | 204/242 |
| 4,039,417 | 8/1977 | Sasaki et al. | 204/291 X |
| 4,116,804 | 9/1978 | Needes | 204/284 |
| 4,169,028 | 9/1979 | Yokoyama et al. | 204/147 |

FOREIGN PATENT DOCUMENTS

| | | | |
|---|---|---|---|
| 51-63496 | 6/1976 | Japan | 204/35 N |

OTHER PUBLICATIONS

Saito et al., Chem. Abs. 87 92659u (1977).

*Primary Examiner*—F. C. Edmundson
*Attorney, Agent, or Firm*—Sughrue, Rothwell, Mion, Zinn and Macpeak

[57] ABSTRACT

A cathode for use in electrolysis comprising (1) a substrate of iron or an alloy thereof; (2) a compact interlayer of $Fe_3O_4$ formed on the substrate, and (3) a coating of activating nickel comprising principally nickel or an alloy thereof formed on the $Fe_3O_4$ layer. In another embodiment, the interlayer (2) may be heat-treated to convert a part of the interlayer (2) into a nickel ferrite. The cathode is especially suitable for use in the electrolysis of an alkali metal halide, such as sodium chloride, using an ion exchange membrane method.

3 Claims, No Drawings

CATHODE FOR USE IN ELECTROLYSIS AND METHOD FOR THE PRODUCTION THEREOF

BACKGROUND OF THE INVENTION

1. Field of the Invention

This invention relates to a cathode for use in electrolysis and to a method for production of the cathode. More specifically, it relates to a cathode which has superior corrosion resistance and a low hydrogen evolution potential and which is suitable for electrolysis of sodium chloride by an ion exchange membrane and to a method for the production of the cathode.

2. Description of the Prior Art

In recent years, the role of cathodes has been considered to be important as in the case of anodes in an electrolytic apparatus for producing hydrogen, sodium hydroxide, chlorine, etc. by electrolyzing an aqueous solution, such as an aqueous solution of sodium chloride.

Iron and mild steel in the form of, for example, a plate, a screen or a perforated plate, have been frequently used as cathodes for use in electrolysis of this kind. Iron is an inexpensive cathode material and has a quite low hydrogen evolution potential. Various activated cathodes obtained by coating iron with various substances to improve its properties are known.

Conventional techniques for providing such activated cathodes include, for example, a method comprising coating a sacrificing metal to be leached out such as Zn or Al together with Ni or the like on a substrate, and leaching out and removing the sacrificing metal to form a porous coating of Ni or the like on the substrate (e.g., as disclosed in, e.g., Japanese Patent Publication No. 6611/56 and Japanese Patent Applications (OPI) Nos. 54877/76 and 36583/77); a method comprising coating an alloy such as a Ni-Mo alloy on a substrate [e.g., as disclosed in British Pat. No. 992,350 (corresponding to Japanese Patent Publication No. 9130/65)]; and a method comprising coating a platinum-group metal oxide or a mixture thereof with another metal oxide (e.g., as disclosed in Japanese Patent Applications (OPI) Nos. 131474/76 and 11178/77).

These conventional cathodes can be expected to provide a considerably reduced hydrogen evolution potential. Although their durability is to some extent feasible under relatively mild conditions as in the conventional diaphragm-method electrolysis of an alkali metal halide, such as sodium chloride, they do not have satisfactory durability under the severe conditions encountered in the ion exchange membrane-method electrolysis of an alkali metal halide, such as sodium chloride, which has been employed in recent years.

In the electrolysis of an alkali metal halide, such as sodium chloride, using an ion-exchange membrane method, the cathode is exposed to a high-temperature, high-concentration sodium chloride solution (usually at about 80° to about 100° C. with a concentration of more than about 25% by weight). Accordingly, the substrate of the cathode tends to be corroded gradually, and this leads to electrode damage even when the cathode has a corrosion-resistant activating cathode coating and is loaded with a negative potential as a cathode.

SUMMARY OF THE INVENTION

An object of this invention is to provide a cathode for use in electrolysis having superior durability and a low hydrogen evolution potential which is free from the defects of the conventional cathodes described above.

Another object of this invention is to provide a method for producing the cathode described above.

The above objects are achieved by a cathode comprising:

(1) a substrate of iron or an alloy of iron;

(2) a compact $Fe_3O_4$ layer having superior electrical conductivity and corrosion resistance on the substrate (1); and (3) a coating of an activating nickel comprising principally Ni or an alloy of Ni on the $Fe_3O_4$ layer (2).

The cathode of this invention is particularly suitable for electrolysis of an alkali metal halide, such as sodium chloride, by an ion exchange membrane method.

In another embodiment of this invention, the invention provides a cathode as described above where at least a part of the $Fe_3O_4$ layer (2) intermediate between the substrate (1) and the coating (3) of nickel or a nickel alloy is heat-treated to convert the layer (2) into nickel ferrite(s) bound to Ni or the like in the coating, thus increasing the adhesion of the layer (2) to the coating (3) of nickel or the alloy thereof and enhancing the durability of the electrode as a cathode.

DETAILED DESCRIPTION OF THE INVENTION

The material of the substrate (1) of the cathode of this invention principally comprises iron, and iron and mild steel, which have been used heretofore, are suitable. Suitable iron alloys are those which contain more than about 50% by weight iron. Specific examples include alloys such as iron-nickel alloys, iron-chromium alloys, carbon steel, silicon steel, and stainless steel can also be used. The substrate (1) may have any desired shape such as that of a rod, a plate, a screen or a perforated plate.

A compact $Fe_3O_4$ layer (2) having superior corrosion resistance and electrical conductivity is provided on the surface of the substrate (1) composed mainly of iron. Such a layer (2) is considered compact if it is impervious to air or other gases such as oxygen. Various known methods can be used for forming the $Fe_3O_4$ layer (2) on the substrate (1). For example, layer (2) may be formed on the iron substrate (1) by thermal deposition. A suitable method is to subject the surface of iron substrate (1) itself directly to an oxidation treatment to convert the surface of the iron substrate (1) to $Fe_3O_4$. Red-hot iron reacts with steam in accordance with the following, with $Fe_3O_4$ being formed easily.

$$3Fe + 4H_2O \rightarrow Fe_3O_4 + 4H_2$$

A typical method, therefore, involves heating, e.g., at about 300° to about 700° C., at least the surface of the iron substrate (1) until it becomes red hot and reacting the surface with steam at a high temperature to form a very compact $Fe_3O_4$ coating (2) directly on the surface of the substrate (1). Other methods, for example, heating iron at about 800° C. in an atmosphere of CO plus $CO_2$ gas whose partial gas pressure is controlled so that the $Fe_3O_4$ produced is stable, can also be used. The thickness of the $Fe_3O_4$ layer (2) is not particularly critical, but the objects of this invention can be fully achieved if the thickness of the $Fe_3O_4$ layer (2) is preferably about 1 to about 10 microns.

The coating material to be coated on the $Fe_3O_4$ layer (2) may be any material which has good corrosion resistance and a low hydrogen evolution potential. A preferred hydrogen evolution potential difference is about 50 mV or lower than that of a conventional mild steel cathode. In the present invention, activating nickel composed principally of Ni or an alloy of Ni, e.g., more than about 50% by weight Ni, is used in view of its cathode activating property, corrosion resistance and bondability to the $Fe_3O_4$ in the interlayer (2).

The activating nickel may, for example, be porous Ni obtained by coating Ni and a sacrificing metal such as Zn or Al on the substrate (1) and then leaching out the sacrificing metal (e.g., as disclosed in U.S. Pat. No. 4,024,044).

The conventional porous nickel coating has the defect that the substrate (1) is corroded by the electrolyte solution that passes through the fine pores.

According to this invention, however, the substrate (1) is protected by the compact $Fe_3O_4$ layer (2) and, therefore, is not corroded. Such a layer (3) of microporous activating nickel is effective for use in the present invention. Layers (2) and (3) cover the substrate (1), thereby protecting substrate (1).

The activating nickel for layer (3) composed mainly of Ni or an alloy of Ni can also be chosen from cathode activating materials, such as alloys of Ni and other metals or compounds and mixtures of Ni and other metals and/or compounds. Examples of other metals which are suitable for coating, e.g., in an amount of up to about 50% by weight, with Ni are Fe, Mo, Co, W, Al, Zn, Sn, Mg, Ti, platinum-group metals, such as Pt, Pd, Ru, Os, Ir and Rh, and oxides of platinum-group metals, such as PtO, $PtO_2$, PdO, $RuO_2$, $OsO_2$, $Rh_2O_3$ and $RhO_2$. Of these cathode activating materials, a mixture of Ni with fine particles dispersed therein of at least one platinum-group metal and/or platinum-group metal oxide has a low hydrogen evolution potential and superior durability. For example, a coating (3) of activating nickel composed of Ni and fine particles of at least one of platinum black, ruthenium black, ruthenium oxideand iridium oxide dispersed therein has a hydrogen evolution potential about 250 mV lower than that of a mild steel cathode and possesses sufficient durability. A suitable thickness for this layer (3) ranges from about 1 to about 200 microns, preferably about 2 to about 50 microns.

The method of coating the activating nickel on the substrate (1) having the $Fe_3O_4$ layer (2) formed on the substrate (1) is not limited in particular. Known means such as electroplating, electroless plating, thermal decomposition, heat fusion, flame or plasma spraying and vacuum deposition can be employed. A preferred method for coating layer (3) of the activating nickel containing the fine particles dispersed therein as described above is described in copending Application Ser. No. 8,812, filed Feb. 2, 1979, filed simultaneously herewith, which disclosure is incorporated herein by reference.

In this manner, a cathode for use in electrolysis having superior durability can be produced which comprises (1) a substrate of iron or an alloy thereof; (2) an intermediate layer of $Fe_3O_4$ formed thereon; and (3) a coating of activating nickel comprising principally Ni or an alloy of Ni on the interlayer (2).

In another embodiment of the invention, the $Fe_3O_4$ in the interlayer (2) and Ni or the like in the coating (3) are fused, e.g., at a temperature of about 600° to about 1200° C. for about 1 to about 10 hours, and bonded to convert at least a part of the interlayer (2) into nickel ferrite(s) (for example, an iron oxide such as $NiFe_2O_4$ and (Ni, Co, Zn)$Fe_2O_4$). This serves to bond the coating (3) more firmly and to increase the durability of the product as a cathode. Formation of the nickel ferrite(s) at the interface between the interlayer (2) and the coating (3) by heat treatment is usually carried out after the coating of the activating nickel. A similar effect can be achieved when prior to the coating of the activating nickel, Ni or the Ni alloy is coated on the $Fe_3O_4$ layer (2) on the substrate (1) by plating or the like and then heat-treated to form at least partly nickel ferrite(s), after which the activating nickel comprising principally Ni or a Ni alloy is coated.

The following examples are given to illustrate the present invention in more detail. Unless otherwise indicated herein, all parts, percents, ratios and the like are by weight.

EXAMPLE 1

The surface of a mild steel plate having a thickness of 3 mm as a substrate was degreased with acetone and then washed with a 10% aqueous solution of hydrochloric acid. The surface of the substrate was then heated and treated with steam at 750° C. for 1 hour to form a compact $Fe_3O_4$ layer having a thickness of about 2 microns on the surface.

Nickel, containing fine particles of ruthenium oxide of a particle size of less than 10 microns and with an average particle size of about 7 microns, was coated on the $Fe_3O_4$ layer to a thickness of about 10 microns by a conventional electroplating method to produce a cathode for use in electrolysis.

The hydrogen evolution potential of the cathode was measured in a 10% aqueous solution of sodium hydroxide at 80° C. using a mercury oxide electrode as a reference electrode. The hydrogen evolution potential was found to be −0.98 V (vs. a normal hydrogen electrode (NHE)) at a current density of 20 A/dm$^2$ and was 240 mV lower than that of mild steel.

Electrolysis was performed continuously for 200 hours in a 30% aqueous solution of sodium hydroxide at 80° C. at a current density of 100 A/dm$^2$ DC using the electrode described above as a cathode. For comparison, electrolysis was performed in the same manner as described above but using a cathode produced by electroplating Ni on a mild steel substrate.

In this comparison, a large amount of a black precipitate formed on the surface of the cathode and separation of the coating of Ni was observed over the entire surface. By analysis, the black precipitate was found to be composed mainly of metallic iron. This shows that the substrate was corroded. In contrast, with the cathode of this invention produced in this Example, no change was seen in the cathode and no appreciable change in weight was observed. The cathode exhibited sufficient durability.

EXAMPLE 2

In the same manner as in Example 1, a layer of $Fe_3O_4$ was formed on a mild steel substrate, and nickel containing ruthenium oxide was electroplated on the $Fe_3O_4$ layer.

The product was then heat-treated at 700° C. for 2 hours in an electric furnace through which a gaseous mixture of 0.95 part by volume of nitrogen and 0.05 part by volume of oxygen was passed, thereby to convert the interface between the nickel and the $Fe_3O_4$ into nickel ferrite. When electrolysis was performed in the same manner as in Example 1, the resulting cathode had a low hydrogen evolution potential [−0.99 V (vs NHE)] and possessed increased durability (e.g., more than 6 months in electrolysis using the ion-exchange membrane method) with good adhesion of the coating. These results demonstrate that this cathode is durable for use in the electrolysis of sodium chloride using an ion exchange membrane method over long periods of time.

EXAMPLE 3

In the same manner as in Example 1, a mild steel substrate was produced, and the surface thereof was heat-treated with steam at 700° C. for 1 hour to form a compact $Fe_3O_4$ layer having a thickness of about 2 microns thereon.

Nickel was electroplated on the $Fe_3O_4$ layer to a thickness of about 1 micron and then heat-treated in an argon gas atmosphere at 800° C. for 2 hours to form nickel ferrite between the nickel and $Fe_3O_4$ layers.

Porous nickel was applied on top of the coating by plating to form a cathode. The hydrogen evolution potential of the cathode so produced, measured in the same manner as in Example 1, was −1.15 V (vs. NHE), which was 70 mV lower than that of mild steel.

A continuous electrolysis was performed for 200 hours in a 30% aqueous solution of sodium hydroxide at 80° C. at a current density of 100 A/dm$^2$ using the resulting cathode. A slight formation of black amorphous nickel was noted on the surface of the electrode. This was due to the dissolving of the porous nickel on the surface, and no nickel was dissolved from the substrate. The cathode was found to have sufficient durability in long-term use.

EXAMPLE 4

In the same manner as in Example 1, a layer of $Fe_3O_4$ was formed on a mild steel substrate, and then nickel was coated on the $Fe_3O_4$ layer to a thickness of about 100 microns using a plasma spray method under the following conditions.

Spray Distance: 10 cm
Spray Temperature: about 3000° C.
Surface Temperature: about 120° C.
Secondary Gas and Pressure: ($Ar:H_2=2:1$ by volume); 3.5 atm (about 50 psi)
Cooling Gas and Pressure: Air; 5 atm (about 70 psi)

The coated product was then heat-treated in air at 700° C. for 2 hours to convert the interface between the $Fe_3O_4$ and the nickel coatings into nickel ferrite.

A thin layer of nickel oxide formed on the surface of the coating by heating in the air was removed with a wire brush, and a cathode was produced.

The hydrogen evolution potential of the cathode thus produced, measured in the same manner as in Example 1, was −1.00 V (vs. NHE), which was 220 mV lower than that of mild steel. This decrease in comparison with the result in Example 3 was due presumably to the increase in the surface area caused by the plasma spray.

The thus-obtained cathode was subjected to a continuous electrolysis for 200 hours in a 30% aqueous solution of sodium hydroxide at 80° C. at a current density of 100 A/dm$^2$ DC. A slight formation of black amorphous nickel was noted on the surface of the cathode. This was due to the dissolving of the nickel layer on the surface, and no dissolving of nickel from the substrate was observed. The amount of the black amorphous nickel that dissolved was very small, and this demonstrated that this cathode would be fully durable in continuous use for long periods of time.

While the invention has been described in detail and with respect to specific embodiments thereof, it will be apparent to one skilled in the art that various changes and modifications can be made therein without departing from the spirit and scope thereof.

What is claimed is:

1. A cathode for use in electrolysis comprising:
(1) a substrate of iron or an alloy of iron;
(2) a compact interlayer of $Fe_3O_4$ on the surface of the substrate (1); and
(3) a coating of activating nickel comprising principally nickel or an alloy of nickel on the $Fe_3O_4$ interlayer (2).

2. The cathode of claim 1, wherein at least a part of the interlayer between said interlayer of $Fe_3O_4$ and said coating of nickel is nickel ferrite.

3. The cathode of claim 1 or 2, wherein the coating of activating nickel comprises at least one cathode activating substance of nickel or an alloy of nickel and fine particles dispersed therein of a platinum-group metal, a platinum-group metal oxide or a mixture thereof.

* * * * *